United States Patent [19]

Wilgus

[11] 4,010,865

[45] Mar. 8, 1977

[54] COLLAPSIBLE INSULATED BOX

[76] Inventor: James L. Wilgus, c/o Reliable Plastics, Inc., 35 Middaugh St., Somerville, N.J. 08876

[22] Filed: Nov. 11, 1974

[21] Appl. No.: 522,327

[52] U.S. Cl. ..... 220/6; 220/62; 229/30

[51] Int. Cl.[2] ..... B65D 7/30; B65D 5/20

[58] Field of Search ..... 220/6.7, 62; 150/15; 229/30

[56] References Cited

UNITED STATES PATENTS

| | | | |
|---|---|---|---|
| 2,144,318 | 1/1939 | Kryder | 150/.5 |
| 2,675,808 | 7/1972 | Brink | 220/7 |
| 3,156,371 | 10/1964 | Harrison | 220/6 |
| 3,246,828 | 4/1966 | Branscum | 220/6 |
| 3,655,114 | 4/1972 | Turner | 220/7 |

FOREIGN PATENTS OR APPLICATIONS

| | | | |
|---|---|---|---|
| 1,177,545 | 9/1964 | Germany | 220/6 |

*Primary Examiner*—George E. Lowrance

[57] ABSTRACT

Various container configurations are disclosed which can be collapsed for storage or shipment when empty and which are readily assembled into sturdy, airtight, and waterproof low-heat-transfer shipping handling or storage containers. Rigid urethane foam is molded to an outer liner in one embodiment and a sealing arrangement such as flexible bead between mating surfaces is disclosed along with other methods for effecting a seal.

3 Claims, 6 Drawing Figures

COLLAPSIBLE INSULATED BOX

BACKGROUND OF THE INVENTION

This invention pertains to containers and more particularly to a shipping container which collaspes for storage and is facilely assembled into a water-proof insulated box.

Transportation of perishable goods especially medicines is increasing each year. Also the variety of goods requiring special treatment has greatly increased as well as the use of aircraft to speed such deliveries. A problem which has become increasingly important deals with the container itself. For ecological as well as other reasons it has become desireable to have reuseable containers to minimize raw material consumption and to protect the environment by reducing waste and disposal problems. However, such containers require and enormous storage facility when not in use. In addition available containers which are substantially airtight, water-proof, and have a low-heat transfer are excessively expensive.

Typically, French Pat. No. 1,392,905 discloses a shipping container, the sides of which are laced together. This arrangement has the advantage that the box disassembles for inventory storage but it is obviously cumbersome to assemble. Also, during shipment if any part of the lacing should become cut (all laces are exposed) the seals are broken. Another prior art arrangement is a thermal liner which is inserted into a fully assembled box. This arrangement (French Pat. No. 1,256,984) however provides no solution to the inventory storage problem.

Another scheme employes a standard cardboard container into which chemicals are injected to create a foam inner liner. This scheme also fails to solve the storage problem of refrigeration container.

Thus it is an object of this invention to provide a container arrangement which is a low heat transfer, waterproof and airtight shipping container which also collaspes for inventory storage and re-assembles quickly with positive sealing.

SUMMARY OF THE INVENTION

The foregoing problems of the prior art as well as the deficiencies of prior designs are overcome by a container in which panels of rigid urethane foam are molded to a continuous liner thus forming an integrated unit. The liner is creased at the intersection of each panel for ease of assembly. The integrated unit lays flat for storage. The panels are molded on the liner in the shape of truncated pyramids and when the container is assembled the sides of the molded panels touch to form an airtight seal.

Another feature of my integrally molded container is an improved seal achieved at all corners by use of rigid urethane plastic for the panels and a bead of flexible plastic or rubber disposed between mating edges of the panels, or a labyrinth profile.

Yet another advantage of my integrally molded container is that I can mold various interior shapes to accomodate special shipment problems, the foam acting as a cushioning as well as an insulation shock absorber.

DESCRIPTION OF DRAWINGS

The foregoing features and advantages as well as others may be appreciated from a reading of the following detailed description with reference to the drawing which comprises FIG. 1 showing a view of one version of a collapsed container suitable as shown for storage.

Figure 1:
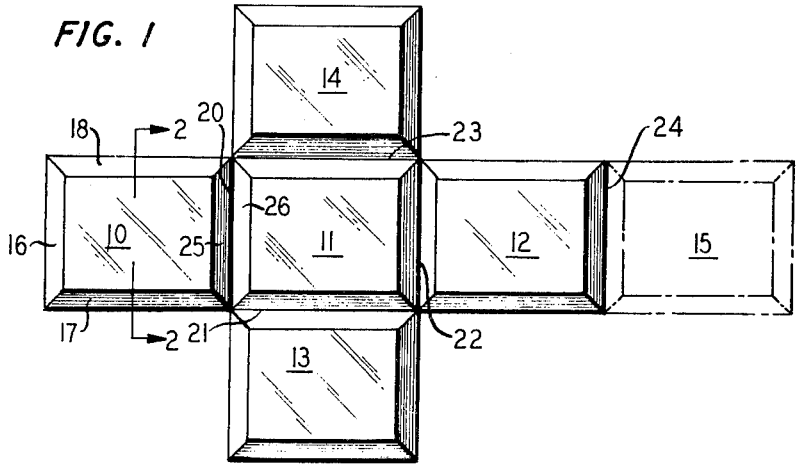
Figure 2:
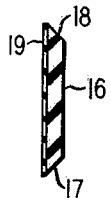
FIG. 2 showing a sectional view taken along section lines 2—2 of FIGS. 1 and 3 describing the insulated panel adhering to the liner.

Beginning initially with the arrangement shown in FIG. 1 as amplified by FIG. 2 my container is shown collapsed. I have chosen to describe a square container having six sides 10–15 with substantially flat interior surfaces. e.g., 16 (FIG. 2). But it should be appreciated at the outset that, for example, rectangularly shaped containers as well as curved interior surfaces are within the scope of this invention.

Side 15 is shown in dotted line to demonstrate an alternative embodiment. Side 15 can be deleted and in its place the cover shown in FIG. 4 can be used to close the box.

Returning to FIG. 1, the liner 19 (FIG. 2) is the outer skin of the container. It is a contiguous sheet substantially of the shape of FIG. 1. Depending on the abrasion resistance desired it can be made of a corregated material (e.g., hemp, paper, plastic, metal, wood (flat sheet stock). It must have the property of flexibility at joints 20–24, as well as a high resistance to tearing or separation at these joints along with rigidity in the plane substantially adjacent to the molded panels (e.g., 16). This rigidity is virtually assured by the strength imparted by the molded urethane panel.

The configuration in FIG. 1 can be made in a mold generally of the shape in FIG. 1 with mating mold depression shaped as in FIG. 2. The liner is laid and the platen or mold lid closed — the plastic is expanded in the mold adhering to the liner in the customary fashion.

To form the box, side 10, 12, 13 and 14 are drawn up until sloping panel surfaces adjacent one another e.g., 25 and 26, are touching. Sloping panel surfaces are at a 46 degree angle with respect to the liner backing of the respective panel and thus the sealing at adjacent surfaces is substantially air and water tight. The exterior surface of liner 19 at mating surfaces, e.g., 18 and 17, can be taped to assure the best seal, if desired.

Figure 3:
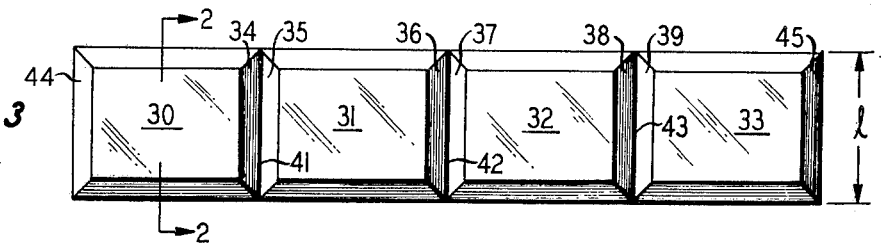
FIG. 3 showing an alternative arrangement of my collapsed container.
Figure 4:
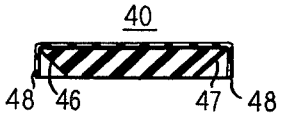
FIG. 4 showing a cross section of a top and bottom lid useable with the container of FIG's 1 or 3.

FIG. 3 shows an alternative arrangement in which only four sides 30–33 of the container are integral with the liner. The container has a top and bottom lid e.g., 40 such as shown in FIG. 4. This arrangement is much simpler for storage. Also the lids can be universal if the open diagonal demension of the formed boxes is constant. If a greater volume is to be accomodated, the *e* demension of FIG. 3 is increased. The container is formed by bringing mating surfaces 44 and 45 into contact necessitating the bending of the liner at hinging surfaces 41–43. This action brings other pairs of mating surfaces, e.g. 34 and 35, into touching contact. The lid 40 has mating sloping surfaces, e.g., 46 and 47 (as well as two others not shown) which contact the upper (or bottom) sloping surfaces of the assembled container. Lid 40 has downwardly extending surface 48 which envelopes the assembled container to hold it without the necessity for taping the normally free edge surfaces 44 and 45 and also to perserve the sealing integrity.

Figure 5:
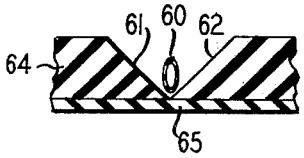
FIG. 5 describing the placement of a bead between adjacent panel surfaces.

FIG. 5 shows what is believed to be a superior seal which insures integrity. Bead 60 may be laid into the corner between adjacent mating surfaces 61 and 62, or it can be glued to one of the two surfaces 61 and 62. When liner 64 is folded at hinging section 65 the substantially rigid surfaces 61 and 62 crush the flexible material of bead 60 sealing the union of the mating surfaces.

Figure 6:
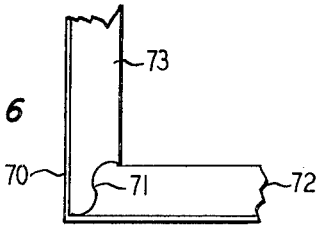
FIG. 6 showing an assembled container which has a labyrinth profile at each corner to improve sealing.

FIG. 6 described a unique configuration of the mating surfaces which increases the total effective length of the touching surfaces and establishes a locking characteristic. The increased length tends to improve the seal achieved and the locking of the mating edges eliminates the necessity for toping, etc. to hold the box closed. Locking surfaces also have pressure fitted surfaces which further seal the container from leaks. Although only one corner profile is detailed here, it will be appreciated that many labyrinth profiles are possible to seal the corners.

What is claimed is:

1. A multi-sided collapsible insulated container comprising a liner composed of a semirigid flexible material segmented into a plurality of contiguous rectangular sections, rigid insulating rectangular panels formed adhering to corresponding sections of said liner by expansion of a rigid urethane foam in a mold having truncated pyramidially-shaped sections corresponding to each of said liner sections, said liner sections combined with said molded urethane foam panels being substantially rigid, each of said molded panels having a truncated pyramid-shaped cellular structure exhibiting a low heat transfer function, adjacent mating side surfaces of each panel being initially molded at an angle of at least 46° with respect to the plane of said liner onto which said panel is formed so as to conform and seal said mating side surfaces by a crushing contact of said mating sides when said container is initially formed.

2. The invention of claim 1 further including a separate top closure for said container when assembled comprising a liner to which is molded a urethane foam truncated pyramidially-shaped lid section with side surfaces mating those of the assembled container, and said lid section side surfaces upon initial contact with said assembled container makes a crushing contact to seal and insulate said container.

3. The invention set for in claim 2 further including a flexible bead adapted to be sandwiched between contacting adjacent side surfaces to seal the joined surfaces.

* * * * *